United States Patent [19]

Ripani et al.

[11] Patent Number: 4,666,090

[45] Date of Patent: May 19, 1987

[54] ROLL DRIVE FOR CHOCOLATE REFINING MACHINES

[75] Inventors: Sergio Ripani; Giulio Serafini, both of Milan, Italy

[73] Assignee: Carle & Montanari, S.p.A., Italy

[21] Appl. No.: 723,208

[22] Filed: Apr. 15, 1985

[30] Foreign Application Priority Data

May 10, 1984 [IT] Italy ..... 20879 A/84

[51] Int. Cl.[4] ..... B02C 4/04; B02C 4/42

[52] U.S. Cl. ..... 241/101.2; 74/665 GE; 241/159; 241/205; 474/88

[58] Field of Search ..... 241/101.2, 227, 229–236, 241/159, 205; 100/172, 162 B, 158 R; 74/665 GE; 474/88

[56] References Cited

U.S. PATENT DOCUMENTS 2,638,388 5/1953 Tunley ..... 241/159 X
3,933,086 1/1976 Standing ..... 241/159 X

FOREIGN PATENT DOCUMENTS 928138 5/1955 Fed. Rep. of Germany ..... 241/159
2632966 1/1978 Fed. Rep. of Germany ..... 241/159

*Primary Examiner*—Mark Rosenbaum
*Attorney, Agent, or Firm*—Kirschstein, Kirschstein, Ottinger & Israel

[57] ABSTRACT

A refining roll drive for chocolate refining machines, wherein motion is transmitted by means of straight-cog pulleys and cogged drive belts. Two drive motors are provided, one on each side of the machine. One motor drives the odd-located rolls, and the other motor drives the even-located rolls. Any oscillable rolls provided would be carried on a common holder also carrying their respective drive motor.

6 Claims, 2 Drawing Figures

ROLL DRIVE FOR CHOCOLATE REFINING MACHINES

BACKGROUND OF THE INVENTION

This invention relates to a refining roll drive for chocolate refining machines.

As is known, with chocolate refining machines, the individual rolls are supported in succession and held in mutual operative connection through their rotary drive gearing. The gears are spiral gears. Accordingly, the drive ratio is a fixed one. Refining machines, as well as pre-refining machines, normally include five rolls, of which the first two form the feeding roll pair, while the third, fourth and fifth rolls form the refining rolls proper. Actually a rectifying action is also performed, however, by the second or feeding roll, which cooperates with the third refining roll. In order to achieve a thickness of the chocolate film being delivered which is as even as possible, the rolls of prior refining machines have a crowned design. Such rolls are then ground when worn. At the same time, their gears are also ground. This grinding operation may usually be carried out once or twice, and is a time-consuming and costly one because it can only be performed, as a rule, at the manufacturer's facilities, which may sometimes be located in some other country, and even in different continents.

In recent years, the Assignee herein disclosed a chocolate refining machine (Italian Patent Application No. 21 857/83) corresponding to U.S. patent application Ser. No. 585,297, filed Mar. 1, 1984, now U.S. Pat. No. 4,603,815, wherein the rolls are manufactured without a crown, a crown-equivalent effect being obtained by letting the rolls rock in a horizontal plane relatively to one another. However, the roll rocking or oscillatory movements are of very low magnitudes, e.g. of about 1 to 2 degrees. The roll oscillations are produced by means of oscillating supports which cooperate with displacement actuators associated therewith.

With conventional refining machines, moreover, the roll rotary drive gears are supported on one side member defining a lubrication chamber having an ample supply of lubricant oil stored in its bottom portion and an oil delivery pump.

The drives equipping prior refining machines have several deficiencies and disadvantages, the outstanding ones of which are listed here below:

the refining roll grinding also involves grinding of the drive gears, which is an expensive procedure and results in the original drive ratios of the machine being altered. Such grinding, which becomes necessary after a number of hours of operation, can only be performed once or twice, for otherwise, dimensional changes would be so significant as to require replacement of the gears or rolls. Consequently, the life of known rectifying machines cannot be extended beyond a certain limit.

The mutual mesh engagement of the refining roll gears results in considerable inflexibility of the drive ratios, whereas to effect the plasticity of the chocolate to be treated, an ability to change them within limits would be desirable.

That end of the refining machine which houses the refining roll gears is constructed as a lubricating chamber containing oil for continuous lubrication and a delivery pump. This chamber requires to be sealed and is closed by means of a large number of bolts. Access to the gears involves preliminary emptying of the oil chamber and removal of the bolts. The time required is quite considerable.

The presence of lubricating oil is increasingly more objected to by food article hygiene regulatory bodies to prevent the assumption of any oil, or smell thereof, into the products being processed.

The drive power is transmitted to one end of a refining roll, generally the delivery roll, so that the torque input end support of the same is applied very high forces tending, as is known, to bend it arcuately. This seriously affects the uniformity of the delivery nip and results in uneven thickness of the chocolate film being delivered. Furthermore, the driving power must be quite high because its transmission by means of V-belts would involve high frictional resistances between the pulleys and belts.

The high powers involved and their direct transmission through gears result in vibration, and by reflection, in noisy operation.

For such drive types spiral gears are employed. These create significant axial stresses on the roll bearings, which bearings are subjected to the adverse effect of a composite, axial and radial, stress.

With single drive refining machines, or machines having separate drives for each roll, it has been found that such a fractioned drive system is in practice even too sophisticated relatively to the interventions required to effect appropriate speed changes to affect the plasticity or degree of fineness of the chocolate being processed.

SUMMARY OF THE INVENTION

A primary object of this invention is to provide a roll drive for chocolate refining machines, which can obviate such prior drawbacks and disadvantages as set forth hereinabove, and extend the working life of chocolate refining machines over the current limits.

A further object of the invention is to afford faultless utilization of the drive both in refining machines of ordinary size, i.e. on the order of about 1.5 meters, and in much larger refining machines, such as machines having refining rolls 2.5 meters long.

In refining machines having fixed axle refining rolls, these objects are achieved by that, according to the invention, a roll drive is provided which is characterized in that:

to rotatively drive the refining rolls, two side-mounted motors are provided, of which one motor drives the even-located rolls and the other the odd-located rolls;

the motion transmission is accomplished through straight cog pulleys and endless cogged drive belts; and the first or feeding roll in the refining machine is driven by a separate motor.

In refining machines having tilting axle refining rolls, according to the invention, two oscillating mounts are provided for the refining rolls on either side of the refining machine, one of said mounts supporting the even-located rolls and the other the odd-located rolls.

According to another aspect of the invention, in refining machines having oscillably mounted refining rolls, two common oscillating mounts are provided on either sides of the refining machines, said oscillating mounts also having supporting parts for the drive motor driving said oscillating rolls.

According to a further aspect of the invention, in order to drive simultaneously both the even-located rolls and odd-located rolls, on each side of the refining machine, that is for each drive motor, there is provided a single cogged drive belt on either sides.

The following advantages are afforded by the inventive drives.

First, the rolls can be repeatedly ground and re-used, since they are no longer interlinked by direct mesh gears, thereby the working life of the refining machine is extended substantially. By splitting the power point of application, hogging of the driven refining roll is avoided, especially in larger size machines, while reducing the pickup current requirements. The use of cogged belts, or spur gears, avoids composite stresses on the bearings and the need for lubrication, while drastically cutting down noise emission.

Construction is simple and reliable.

BRIEF DESCRIPTION OF THE DRAWINGS

Further advantages, details, and features of the drive of this invention will be apparent from the following description of a preferred embodiment thereof, with reference to the accompanying schematic drawing, where.

DESCRIPTION OF THE PREFERRED EMBODIMENT

Figure 1:
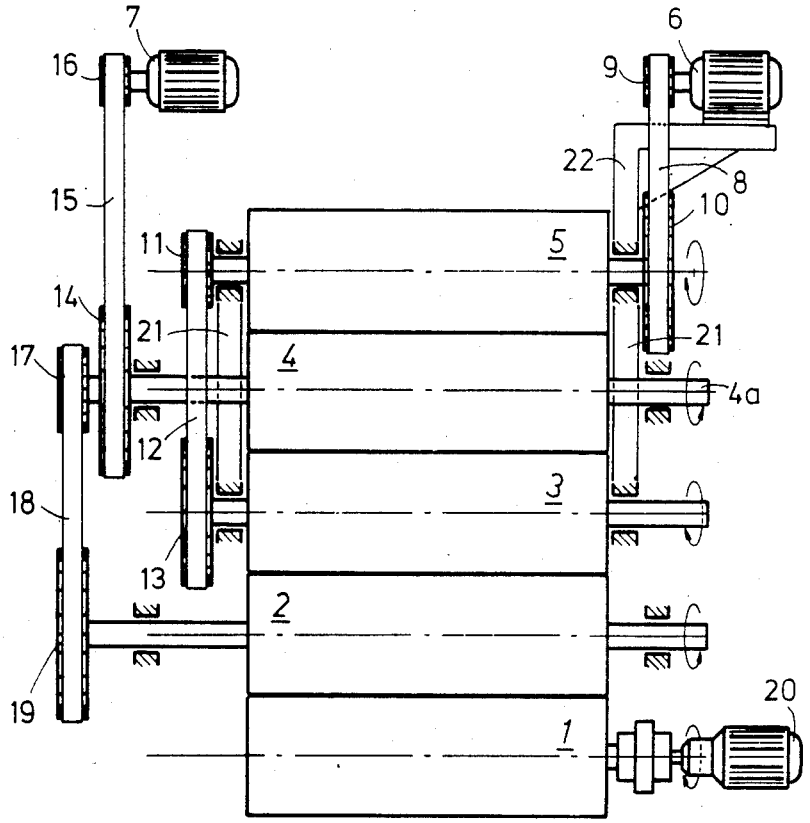
FIG. 1 is a general front elevation view showing the basic arrangement of a chocolate refining machine incorporating a drive according to the invention.

In the drawing figures, the refining machine rolls are indicated at 1,2,3,4 and 5. The rolls 1 and 2 form the feeding roll pair, while the rolls 3,4 and 5 are the refining rolls proper. The roll 2 performs at one time chocolate feeding and refining functions. This arrangement is the usual arrangement with known refining machines irrespective of their design. As is apparent from the drawing, power is applied to the machine through two motors, namely the motor 6 and motor 7. Indicated at 8 is a cogged belt trained between the cog pulley 9 of the motor 6 and cog pulley 10 of the roll 5. The latter carries, at its other end, a cog pulley 11 around which is trained a cogged belt 12 also trained around the pulley 13 of the refining roll 3. The refining roll 4 is driven through its pulley 14 by the cogged belt 15 engaging with the cog pulley 16 of the motor 7. Keyed to the shaft 4*a* of the roll 4 is a cog pulley 17, which has the cogged belt 18 trained therearound from the cog pulley 19 of the feeding roll 2. Thus, the motor 6 drives the rolls 5 and 3, or odd-located rolls, and the motor 7 drives the rolls 4 and 2, or even-located rolls.

The feeding roll 1 is driven by a separate motor unit 20.

Figure 2:
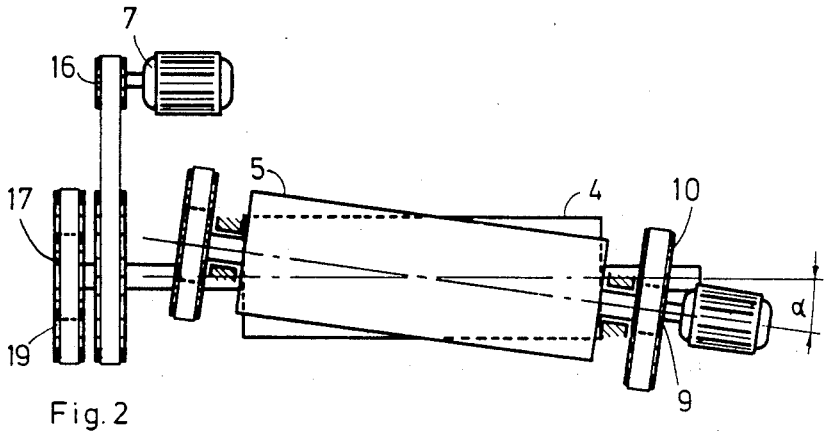
FIG. 2 is a top view of the machine of FIG. 1, with a tilted pair of refining rolls.

In the example shown, the rolls 5 and 3 can be made to oscillate relatively to the rolls 4 and 2 because the rolls 5 and 3 are mounted on common oscillable mounts 21. Shown in FIG. 2 is a tilted position of said rolls 3 and 5 and respective drives. Associated with the mount 21 is a mount 22 supporting the drive motor 6 to allow of a simultaneous oscillation of the same not to torsionally load the cogged belt 8.

While being apparently simple, the proposed drive distinguishes itself from prior drives in chocolate refining machines, and effectively achieves the invention objects and affords the cited advantages therein. In particular, the roll grinding is made independent of that of the gears associated, with the result of increasing the working life of the machine and of manipulating the drive ratios between rolls to change the chocolate plasticity or fineness. At the same time, by splitting the motion application, any hogging of the driven roll is prevented as is, accordingly, uneven thickness of the refined chocolate film, even with great width refining machines. By reducing the pickup torque, there is no need to renew or boost the power supply network. By avoiding direct meshing of the gears and using two motors, vibrations and the operating noise are cut down considerably. At the same time, lubrication is rendered unnecessary, and the assumption of oil smell into the product being treated is avoided in a most positive way, while preventing any oil leakage and making the moving parts of the refining machines more readily accessible.

Also avoided are adverse axial stresses on the bearings. The use of cogged belts in lieu of V-belts in the drive from the motors to the rectifying rolls allows a drastic reduction of the belt tension required, which enables the loads on the bearings and shaft of both the motors and rectifying rolls affected by the drive to be cut down from two to three times less. Another advantage is that the drive herein proposed may be used in refining machines with oscillable refining rolls. With the proposed drive, moreover, an improvement is advantageously achieved in the uniformity of the chocolate film being delivered. With conventional drives, the high tension on the belts, which reaches some hundred kilograms, caused indeed an anomalous deformation in the crowning of the delivery roll, and coarser fineness was experienced at the area adjacent the motor, on the order of two or more microns. In view of the small dimension of usual thicknesses, e.g. on the order of 15 to 30 microns, such deviations are quite important. Another advantage resides in that the proposed drive is quite simple construction-wise and allows an increase in the working width of refining machines, as mentioned, up to about 2.5 meters.

The proposed drive also enables a structural simplification of recent oscillating roll refining machines.

In practice, all of the individual parts may be replaced with technically and/or functionally equivalent ones, such as for example as regards the keying of the rolls, the width selected each time for the cogged belts, and so on, as well as the arrangement of belt tensioners or the like parts, without departing from the protection scope of this invention. In the instance of refining and pre-refining machines, it would also be possible to replace a plurality of inside cogged belts with one or more belts formed with both inside and outside cogs.

All of the features which appear from the description, claims, and drawing are regarded as being substantial to this invention, both individually and in any combination thereof.

We claim:

1. In a chocolate refining machine of the type having a plurality of generally cylindrical feeding and refining rolls mounted on the machine for rotation about respective generally horizontal, mutually parallel, axes situated at different elevations, a lowermost roll and every other roll above the lowermost roll constituting a first set of rolls, all the other rolls constituting a second set of rolls, a roll drive arrangement for rotating the rolls for conveying chocolate paste to be refined from the lowermost roll to the other rolls, comprising:

(a) first drive means situated at one axial end region of the rolls, for driving the first set of rolls in a predetermined circumferential direction of one sense; and (b) second drive means situated at an opposite axial end region of the rolls, for driving the second set of rolls in an opposite circumferential direction of an opposite sense to that of said first set of rolls.

2. The roll drive arrangement as recited in claim 1, wherein the first drive means includes a first electrical motor operatively coupled in force-transmitting relationship to the lowermost roll, and a second electrical motor operatively coupled in force-transmitting relationship to every other roll in said first set of rolls.

3. The roll drive arrangement as recited in claim 2, wherein the second drive means includes a third electrical motor operatively coupled in force-transmitting relationship to all the rolls in said second set of rolls.

4. The roll drive arrangement as recited in claim 3, wherein each of said second and third drive motors has a drive shaft on which a straight cog pulley is mounted for joint rotation, and wherein at least one of the rolls of each of said first and second sets of rolls has a driven shaft on which another straight cog pulley is mounted for joint rotation, and wherein an endless cogged drive belt is trained about the pulley on each drive shaft and the pulley on each said one roll.

5. The roll drive arrangement as recited in claim 4 and further comprising means mounting said every other roll above the lowermost roll in said first set of rolls in a common first tilt mount at said one axial end region, and means mounting said all the other rolls in said second set of rolls in another common second tilt mount at said opposite axial end region.

6. The roll drive arrangement as recited in claim 5, wherein said second electrical motor is mounted for joint tilting movement on said first tilt mount.

* * * * *